US009259757B1

(12) United States Patent
Santarsiero

(10) Patent No.: US 9,259,757 B1
(45) Date of Patent: Feb. 16, 2016

(54) REPAIR COMPOUND DELIVERY DEVICE

(71) Applicant: Paul Santarsiero, Avon, CT (US)

(72) Inventor: Paul Santarsiero, Avon, CT (US)

(73) Assignee: Paul Santarsiero, Avon, CT (US)

( * ) Notice: Subject to any disclaimer, the term of this patent is extended or adjusted under 35 U.S.C. 154(b) by 257 days.

(21) Appl. No.: 14/040,568

(22) Filed: Sep. 27, 2013

(51) Int. Cl.
*B43K 23/12* (2006.01)
*B05C 17/10* (2006.01)
*B05C 17/005* (2006.01)

(52) U.S. Cl.
CPC ..... *B05C 17/10* (2013.01); *B05C 17/00516* (2013.01); *B05C 17/005* (2013.01); *B05C 17/00583* (2013.01)

(58) Field of Classification Search
CPC ..... B05C 17/10; B05C 17/005; B05C 17/00583; B05C 17/00516
USPC ..... 401/261, 262, 266, 183, 184, 185; 15/235.4, 235.5, 235.7
See application file for complete search history.

(56) References Cited

U.S. PATENT DOCUMENTS

| | | | | |
|---|---|---|---|---|
| 5,017,113 | A * | 5/1991 | Heaton et al. | 425/87 |
| 5,865,555 | A * | 2/1999 | Dawson | 401/266 |
| 6,375,377 | B1 * | 4/2002 | Lowery | 401/266 |
| 6,536,798 | B1 * | 3/2003 | Hamilton | 280/735 |
| 6,767,151 | B1 * | 7/2004 | Owens | 401/266 |

* cited by examiner

*Primary Examiner* — Jennifer C Chiang

(57) ABSTRACT

A delivery device delivers a repair compound from a container with which it is assembled, and includes an integral smoothing tool or blade part. The container has an opening end finish, allowing the repair compound to enter, and extrude from, a nozzle part of the delivery device when the container is squeezed. A portion of the blade part exhibits transverse flexibility to facilitate smoothing of a deposited repair compound. The blade part also functions to effect closure of a terminal end orifice of the nozzle part, typically having a closure plug that enters the orifice to form a seal when disposed, by flexure of the blade part, in a closing position relative to the nozzle. Alternatively, the blade part may be capable of linear articulation to achieve closure at the nozzle orifice, and the sealing element may comprise a flat surface. The device enables one-handed setup, dispensing, closure, and smoothing of a deposited repair compound.

18 Claims, 14 Drawing Sheets

1
11
6
2
5
12'
12
18
3

1'
10
4
5'
5
1
6
1'
8
2
11
12
9
3

1
6
8
2
12'
1
14
18
12
3

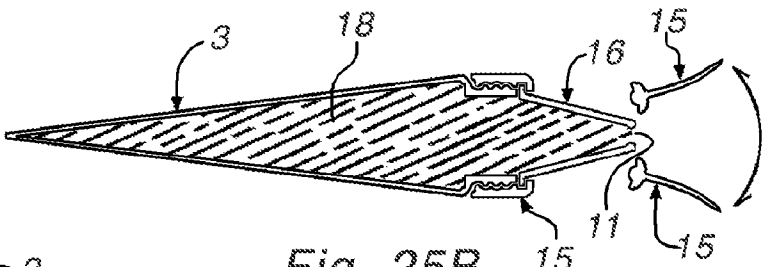
Fig. 25B
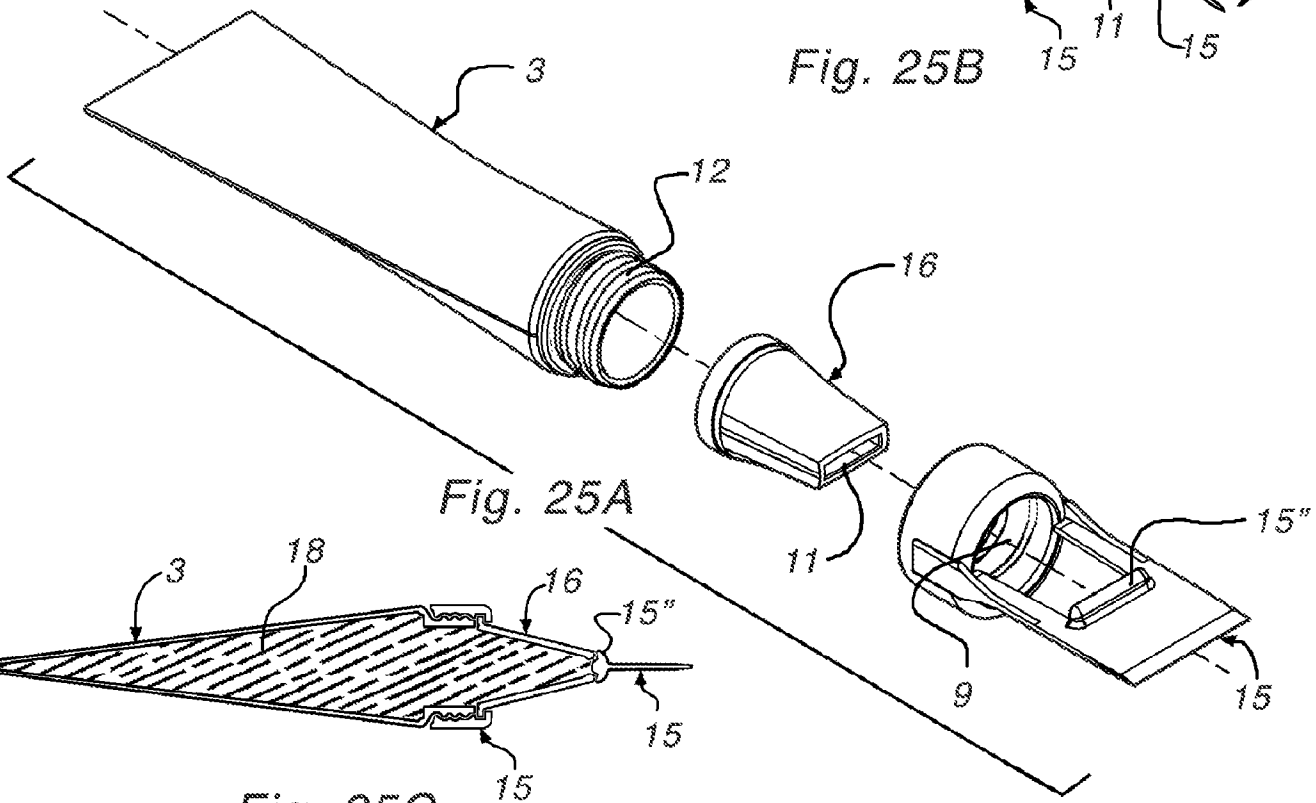
Fig. 25A
Fig. 25C

REPAIR COMPOUND DELIVERY DEVICE

BACKGROUND OF THE INVENTION

It is well known that consumers desire to quick and easily repair method for filling small holes and dents in a dwellings interior wallboard, exterior siding, furniture, and wherever plaster, putty, or wood filler is called for. The state of the art for dispensing and delivering Chalk, plaster, spackle and repair filler compounds presently does not address the consumers need to have a product containing a repair compound dispenser combined with a blade tool for smoothing out the dispensed material. The following United States patent documents represent prior art that could be considered germane to the present invention:

U.S. Pat. No. 1,390,126
U.S. Pat. No. 1,604,792
U.S. Pat. No. 2,236,727
U.S. Pat. No. 2,804,767
U.S. Pat. No. 2,884,877
U.S. Pat. No. 2,914,798
U.S. Pat. No. 2,988,775
U.S. Pat. No. 3,087,654
U.S. Pat. No. 3,411,178
U.S. Pat. No. 3,744,079
U.S. Pat. No. 3,761,992
U.S. Pat. No. 3,846,060
U.S. Pat. No. 5,033,951
U.S. Pat. No. 5,471,704
U.S. Pat. No. 5,675,860
U.S. Pat. No. 5,792,489
U.S. Pat. No. 6,419,773
U.S. Patent No. 20100162509

A variety of wallboard and putty dispensing devices and tools to smooth out the dispensed repair compound have been developed and marketed. More recently, the consumer has seen new product offerings that allow you to patch small holes caused by picture hook nails or screws marketed in small dispensing bottles. The invention utilizes an integral blade that functions both to smooth out the dispensed putty, and also to provide an air-tight seal for the containers dispensing orifice, while offering low manufacturing cost and substantially increased ease of use to the consumer.

SUMMARY OF THE INVENTION

People have ongoing needs to repair small nail holes, screw holes and small dents or scratches in their dwelling's interior wallboard, exterior siding, and furniture; especially when they are preparing them for the application of paint, stain, or other finishes. Today's consumer has shown a strong desire purchase products that offer both ease of use and a time savings for the choirs of this type. By combining the dispensing of the repair compound with an integral smoothing blade that doubles as a closure devise, the invention offers the consumer a unique time saving option for small hole, scratch, and dent repair. It is the scope of the invention to accommodate any suitable compound for use in repairing and filling small to medium sized holes and dents in home interior and exterior walls, furniture, automotive exterior surfaces, and any project that the consumer would typically reach for a putty knife to administer a filler compound into a void. The invention allows for the dispensed repair compound to easily fill a desired void through the pressure and motion exerted by the user on the integral smoothing blade while spreading it across the repair compound.

The present invention:

A means of dispensing a repair compound from a tube or compressible container in which the invention will allow the consumer through a single motioning of their arm, to direct the compound into void and smooth it out with a single pass over the void. The repair compound(s) is dispensed by squeezing the container or tube which extrudes the compound out of a nozzle or orifice found on one end of the container or nozzle. The container that dispenses the compound has an end finish assembly that allows the compound to be delivered into a void, nail hole, or damaged surface with the viscosity of the compound allowing it to adhere to both horizontal and vertical surfaces. When the invention is motioned opposite to the direction of the dispensing of the compound and downward pressure is applied, the smoothing blade edge will come in contact with the compound and function as a putty knife, applying pressure and smoothing the compound into the desired location on the surface to be repaired. In all versions of the invention, the nozzle's end dispensing area is to meet or be intersected with a pivotable and/or sliding plate or plug which is integral to the smoothing blade, and located opposite to it's leading edge. This allows the repair compound in the container to have an air-tight seal at the point of the nozzle exit, and allows for long term storage while maintaining the viscosity and freshness of the repair compound. Various styles of containers can be employed to allow for the containment of the repair compound with each allowing for the pressure displacement of the compound out of the nozzle finish, thus extruding the compound out of the nozzle.

More specifically, in a first embodiment the invention provides a delivery device that enables a user to single-handedly dispense repair compound received from a container and also to smooth the dispensed repair compound deposited upon a receiving surface; and in a second embodiment the invention provides a repair-compound dispenser comprised of a container that is at least partially compressible and is constructed for dispensing a repair compound contained therein from an opening thereof when it is compressed, in combination with such a delivery device. In all embodiments, the delivery device comprises:

a dispensing nozzle part that is constructed for engagement with a container and that has a passageway for the passage of a repair compound received through a rearward inlet end of the passageway to a forwardly spaced outlet orifice thereof;

a smoothing blade part operatively associated with the nozzle part and having a blade portion that extends forwardly beyond the outlet orifice of the nozzle part passageway and that terminates in a generally rectilinear leading edge, the blade portion being constructed for forcing a repair compound into subsurface recesses and defects of a receiving surface on which the repair compound is deposited, and for smoothing the surface of the deposit; and a closure element on the blade part that is constructed to close the forwardly spaced outlet orifice of the nozzle part passageway, the blade part being movable between a closing position, in which the closure element effectively closes the outlet orifice of the nozzle part, and at least one opening position in which the closure element is displaced from the outlet orifice to permit repair compound to pass therethrough, at least one of the dispensing nozzle part and the smoothing blade part having means thereon for attachment of the delivery device to such a container with the passageway of the nozzle part positioned to receive repair compound from an opening of the container.

The blade part of the dispenser will desirably be slidably mounted on the nozzle part for linear movement between the closing position and the at least one opening position. The nozzle part may comprise a tubular portion, located rearwardly of the outlet orifice and having a longitudinal axis, with the blade part comprising a coaxial collar portion that at least partially encircles the tubular portion of the nozzle part. In certain embodiments at least the exterior of such a tubular portion of the nozzle part will be substantially cylindrical and the collar portion will be ring shaped, the delivery device being constructed to prevent relative rotation of the blade part on the nozzle part about the longitudinal axis of the tubular portion. Preferably, such a collar portion will have at least one structural feature for enhancing manual engagement thereof, to thereby facilitate one-handed movement of the blade part between the closing position and the at least one opening position while the dispenser is being held by the same hand.

The blade part of the delivery device will normally comprise a forwardmost, generally planar plate portion on which the rectilinear leading edge is provided, and a pair of laterally spaced rails connecting the plate portion to the collar portion and defining an open area therebetween. In such embodiments the outlet orifice of the passageway of the nozzle part will be aligned with the open area of the blade part, in an opening position thereof, so as to permit passage of repair compound through the open area for deposit upon such a receiving surface. The rails of the delivery device will generally be constructed to permit resilient deflection of the plate portion of the blade part in opposite, transverse directions, generally normal to the plane thereof, in reaction to applied force. In certain embodiments the plane of the plate portion of the blade part will desirably be offset substantially from the longitudinal axis of the tubular portion of the nozzle part, in an unflexed position of the plate portion. The bearing surface of the closure element on the blade part may bear upon structure defining the outlet orifice of the nozzle part passageway, to effect sealing of the outlet orifice in the closing position of the blade part, in which embodiment the bearing surface of said closure element will desirably be substantially flat.

The nozzle part of the delivery device may define a channel that extends inwardly from a forward end thereof, and that has a bottom wall in which the outlet orifice is formed. In such embodiments the blade part will include a rearward end portion that is slideably received in the channel of the nozzle part, for movement between the closing position and the open position; the rearward end portion of the blade part will overlie the outlet orifice to block the flow of repair compound therethrough in the closing position.

The closure element of the dispenser may be of plug-like form, and reside within the outlet orifice of the passageway in the closing position. A gasket element may desirably be associated with either the structure that defines the outlet orifice of nozzle part passageway or the closure element of the blade part, such that the gasket element will be in direct surface contact with the closure element or the orifice-defining structure, respectively, to promote air-tight sealing of the outlet orifice in the closing position. The passage of the nozzle part will preferably include a portion, proximate the outlet orifice, that tapers in the direction of the orifice.

In the dispenser of the invention, the delivery device is provided in combination with a container, which container will normally take the form of a resilient tube or bottle, or be of substantially bellows-like form. In some instances the nozzle part of such a dispenser will be integral formed with the container, with means for attachment being provided by the blade part. Alternatively, the nozzle part and the blade part may comprise an assembly that is disengageable from the container and is attached thereto by the means for attachment. In such embodiments, the nozzle part will be constructed for engagement with the container and for communicating with the opening of the container for passage of the repair compound into the passageway of the nozzle part.

BRIEF DESCRIPTION OF THE ILLUSTRATED EMBODIMENTS

FIG. 1 illustrates a preferred embodiment of the invention in perspective view. The integral smoothing blade is shown as part 1 in it's sealed closed, non-dispensing position. Thumb grip 5 allows the user to slide part 1 forward to dispense and backward to seal the repair compound in container 3.

FIG. 2 illustrates the preferred embodiment with the invention and it's smoothing blade 1 shown in open and closed positions.

FIG. 3 illustrates the preferred embodiment with the smoothing blade 1, in open, flexed position and the container 3, dispensing repair compound 18.

FIG. 4 illustrates the preferred embodiment in perspective view, with the smoothing blade 1, in open position and container 3, dispensing the repair compound 18, and with leading edge 4 smoothing the compound on the desired surface with the desired pressure, angle to the planar surface, and directional force that the user defines as optimal for a given repair.

FIG. 5A illustrates an exploded view of the preferred embodiment assembly showing the standing rib 6 extending from part 1 in an orientation to allow for intersection with nozzle 2 end opening 11.

FIG. 5B illustrates a section view of the preferred embodiment front half assembly showing the closure plug 6 disengaged from nozzle 2, along with the flexing direction and limits of smoothing blade 1 while in use.

FIG. 5C illustrates a section view of the preferred embodiment front half assembly showing the closure plug 6 engaged into nozzle part 2, along with the addition of the pliable gasket 8, achieving an air-tight closure for the contained repair compound 18.

Figure 13A:
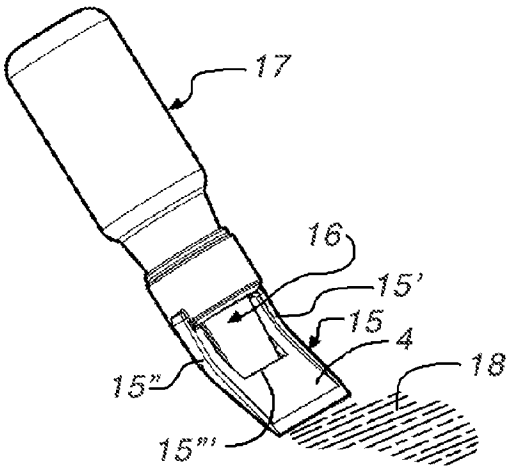
FIG. 13A illustrates the above alternate embodiment as seen in a perspective view, dispensing the repair compound 18.
Figure 13B:
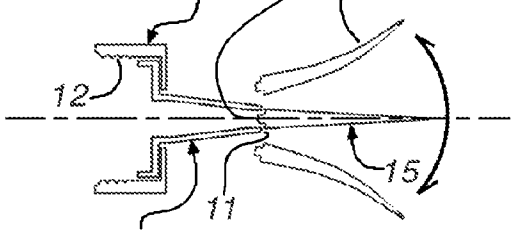
FIG. 13B illustrates a partial assembly embodiment as seen in a sectional view, showing the smoothing blade 15 range and direction of travel.
Figure 13E:
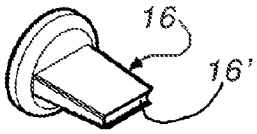
FIG. 13C illustrates a partial assembly embodiment as seen in a sectional view, showing the smoothing blade 15 range and direction of travel with an optional articulated tension seal 6' shown.
Figure 13C:
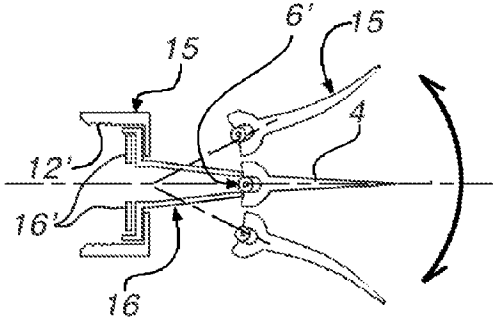
Figure 13D:
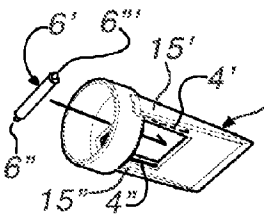

FIG. 13D illustrates a partial exploded view embodiment of the smoothing blade 15 with the optional articulated tension seal 6' which shows it's twin pivot ends 6" and 6'" and their respective locator receptor grooves 4' and 4".

FIG. 13E illustrates the nozzle 16 as seen in perspective view, showing the end orifice termination point 16'.

Figure 14:
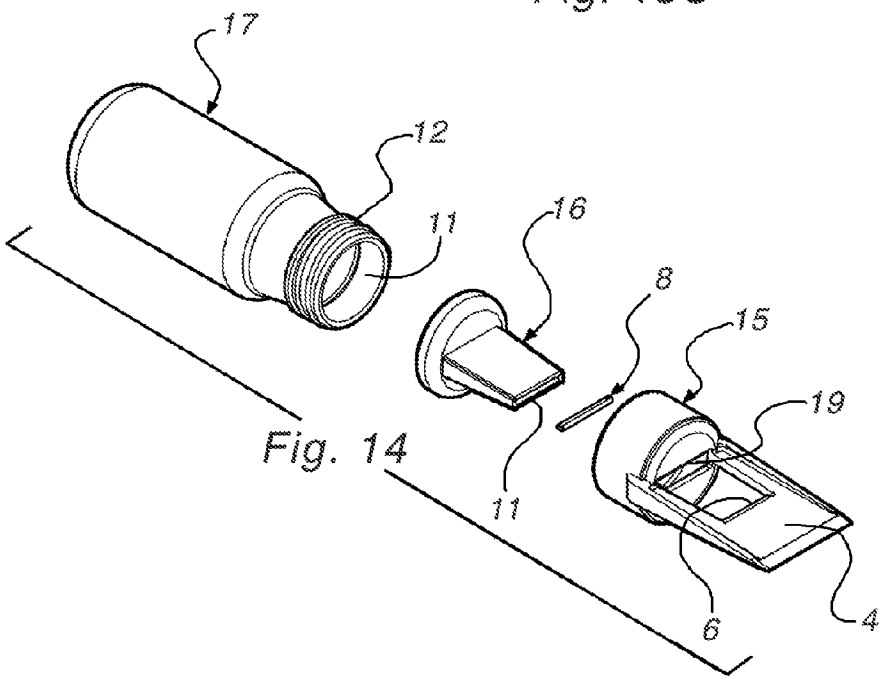

FIG. 14 illustrates the above alternate embodiment as seen in an exploded view.

Figure 15:
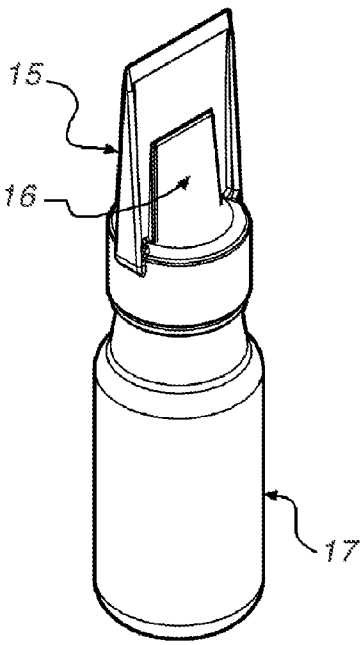

FIG. 15 illustrates the above alternate embodiment as seen in a vertical standing perspective view, and showing container 17, nozzle 16, and knife 15.

Figure 16:
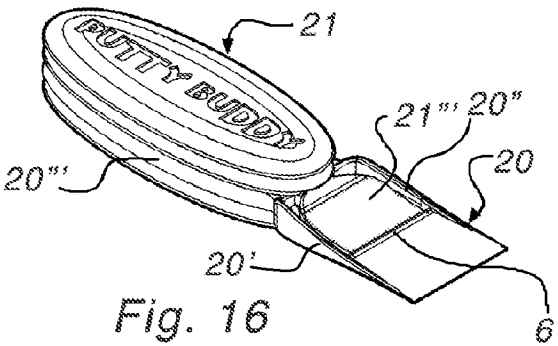

FIG. 16 illustrates an alternate embodiment for the invention comprised of bellows container 21, and smoothing blade 20.

Figure 17:
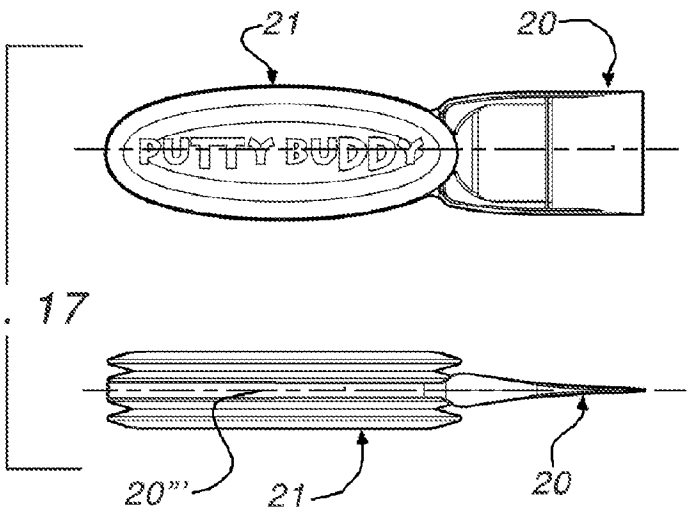

FIG. 17 illustrates the above alternate embodiment as seen in top and side orthographic views.

Figure 18:
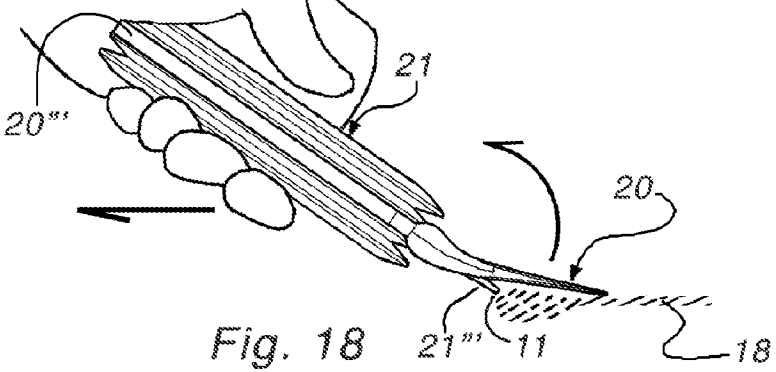

FIG. 18 illustrates the above alternate embodiment as seen in a side orthographic view while dispensing compound 18.

Figure 19:
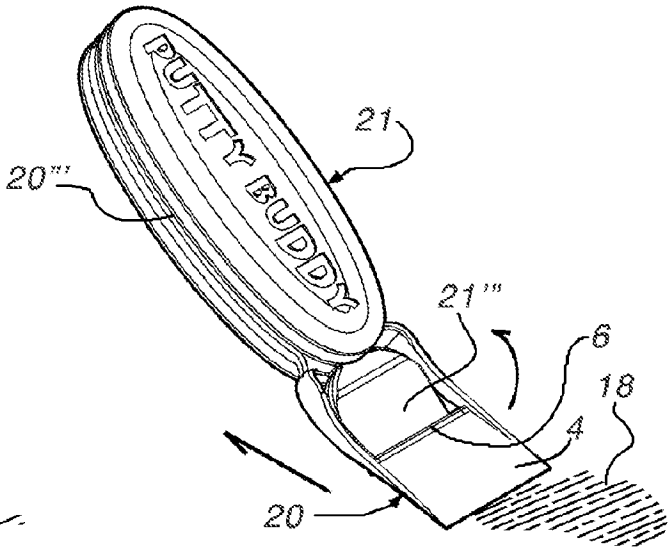

FIG. 19 illustrates the above alternate embodiment as seen in perspective view while dispensing compound 18.

Figure 20:
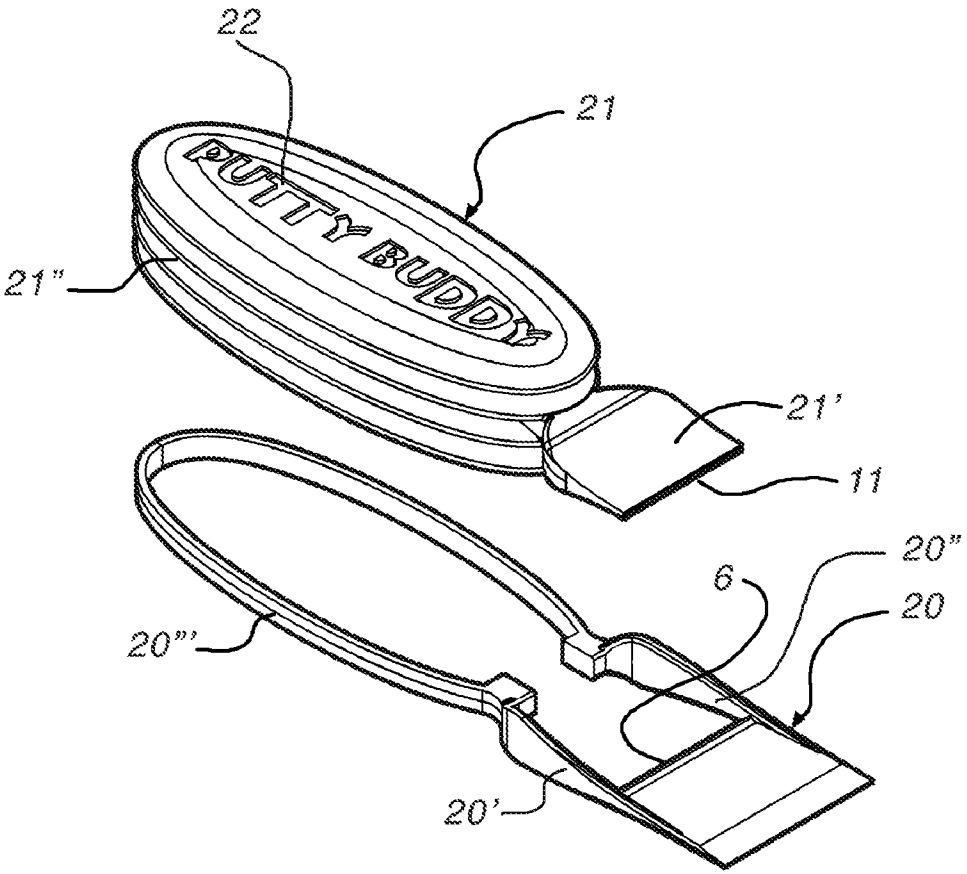

FIG. 20 illustrates the above alternate embodiment as seen in an exploded view showing bellows. Container 21 and the containment hoop 20''' of smoothing blade 20.

Figure 21:
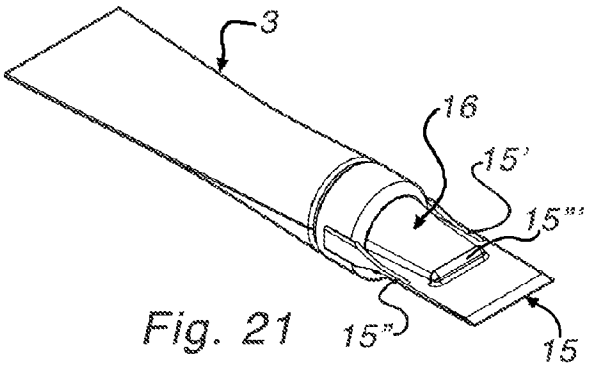

FIG. 21 illustrates an alternate embodiment for the invention in which knife 15 flexes along twin rails 15' and 15'', pivoting up or down and away from its fixed horizontal.

Figure 22:
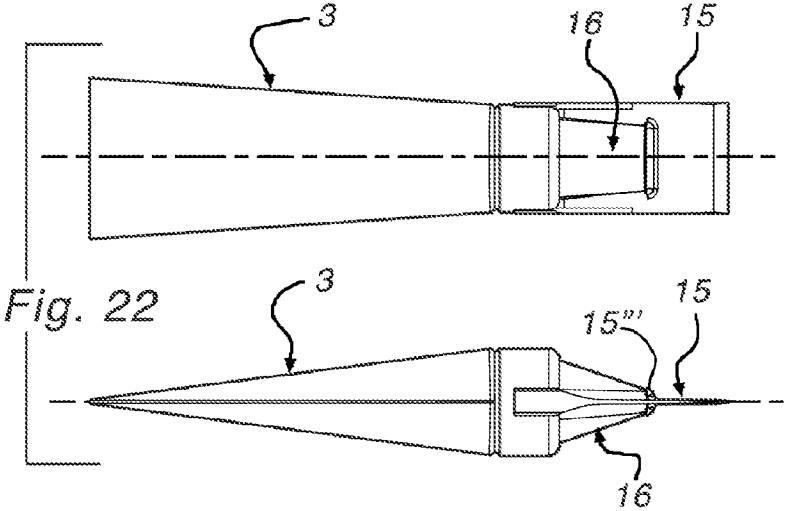

FIG. 22 illustrates the above alternate embodiment as seen in a side view, and showing container 3, nozzle 16 and knife 15.

Figure 23:
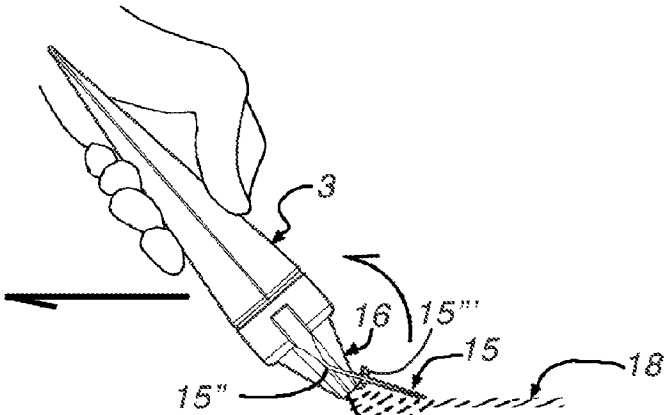

FIG. 23 illustrates the above alternate embodiment in side orthographic view, dispensing the repair compound 18.

Figure 24:
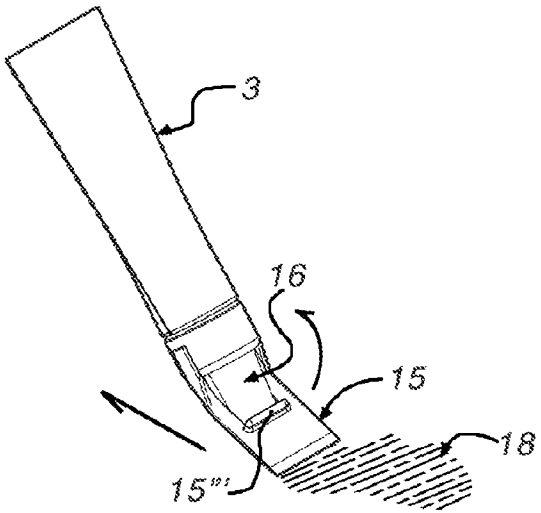

FIG. 24 illustrates the above alternate embodiment in perspective view, dispensing the repair compound 18.

FIG. 25A illustrates the above alternate embodiment as seen in an exploded view, and showing container 3, screw threads 12 on container 3, screw threads 9 on knife 15, nozzle 16 with it's dispensing opening 11''.

FIG. 25B illustrates the above alternate embodiment as seen in a section view, and showing smoothing blade 15 and it's range and direction of motion.

FIG. 25C illustrates the above alternate embodiment as seen in a section view with smoothing blade in it's closed position sealing the container and it's contents.

Figure 26:
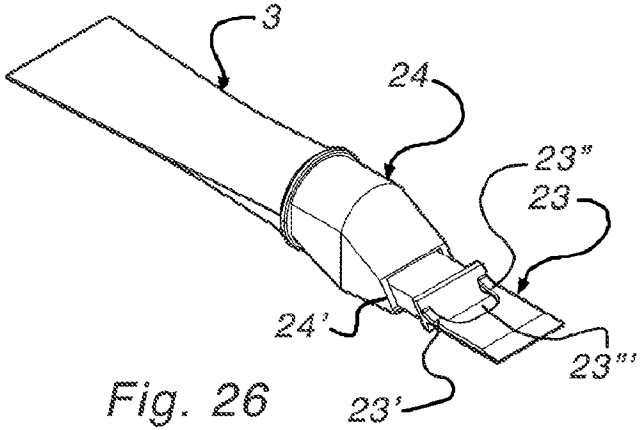

FIG. 26 illustrates an alternate embodiment for the invention in which smoothing blade 23 motions forward to open an orifice on it's underside to allow compound 18 to be dispensed.

Figure 27:
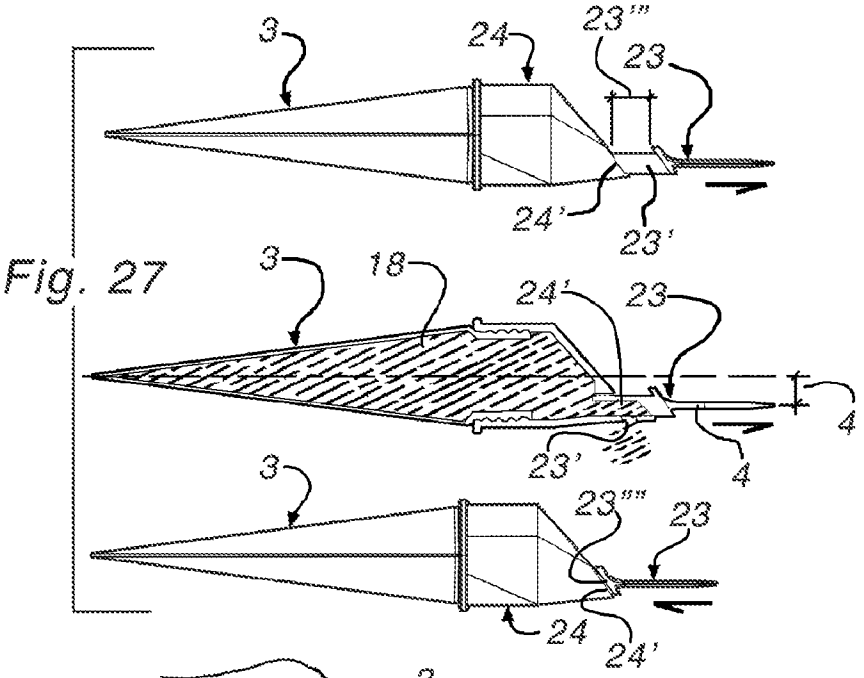

FIG. 27 illustrates the above alternate embodiment as seen in sectional view and two side views.

Figure 28:
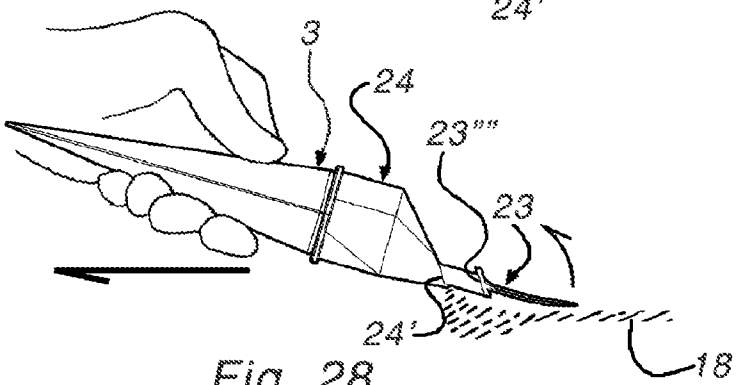

FIG. 28 illustrates the above alternate embodiment in side orthographic view, dispensing the repair compound 18.

Figure 29:
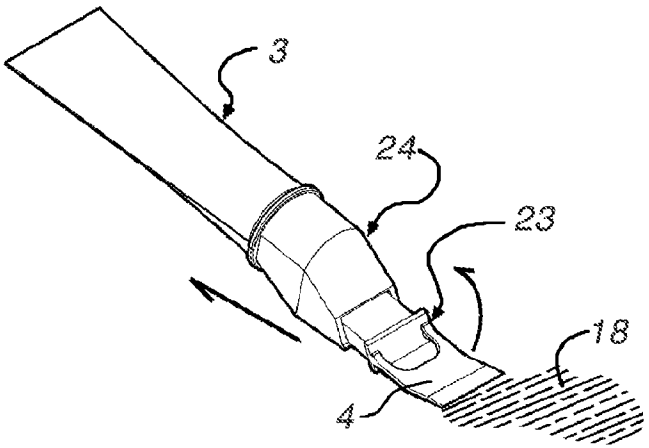

FIG. 29 illustrates the above alternate embodiment in perspective view, dispensing the repair compound 18.

Figure 30:
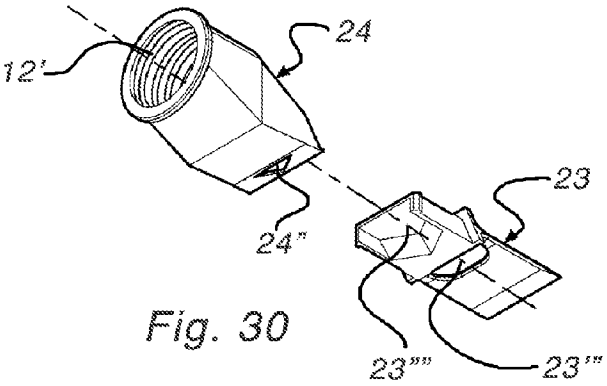

FIG. 30 illustrates the above alternate embodiment as seen in a partial exploded view underside showing smoothing blade 23 disengaged from the nozzle 24.

Figure 31:
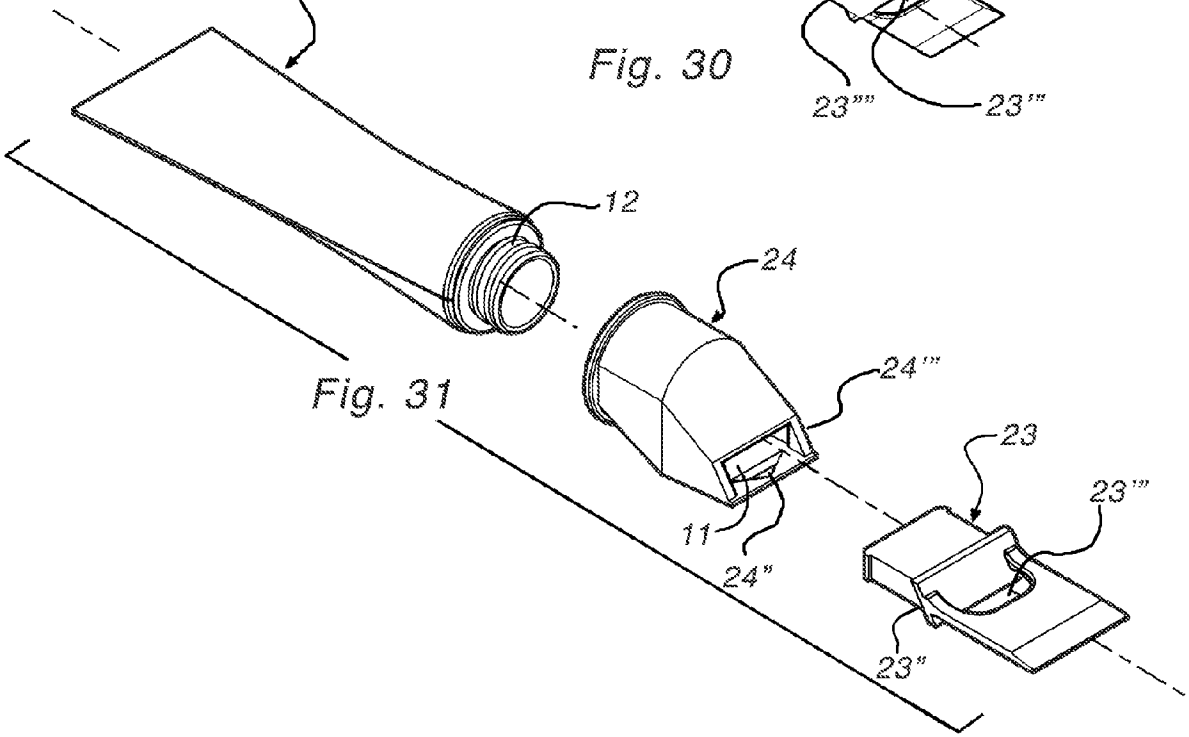

FIG. 31 illustrates the above alternate embodiment dispensing the repair compound 18 and as seen a perspective view.

Figure 32:
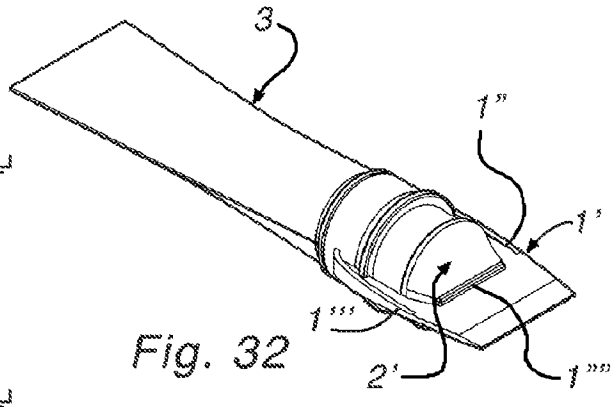

FIG. 32 illustrates an alternate embodiment for the invention which includes a container 3, and an articulating, forward and backward sliding Smoothing blade 1'.

Figure 33:
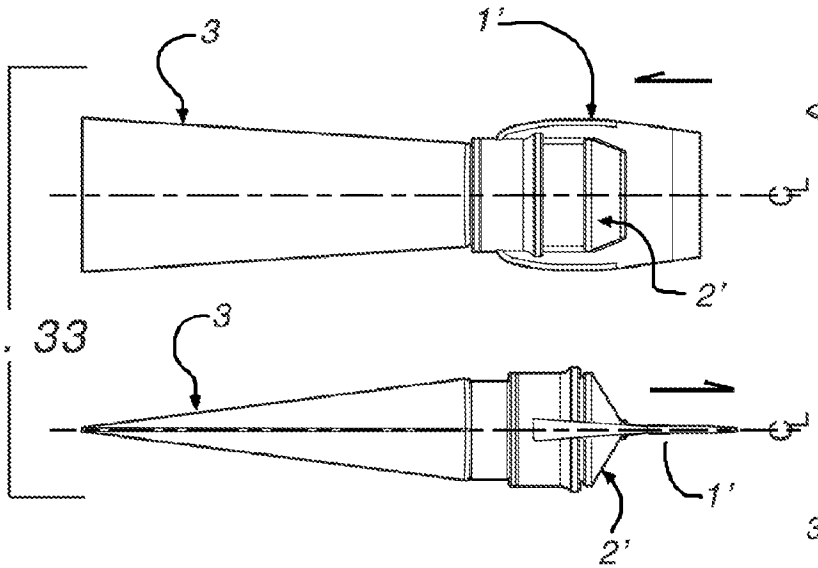

FIG. 33 illustrates the above alternate embodiment as seen in side and top views, and showing container 3, nozzle 2', and smoothing blade 1'.

Figure 34:
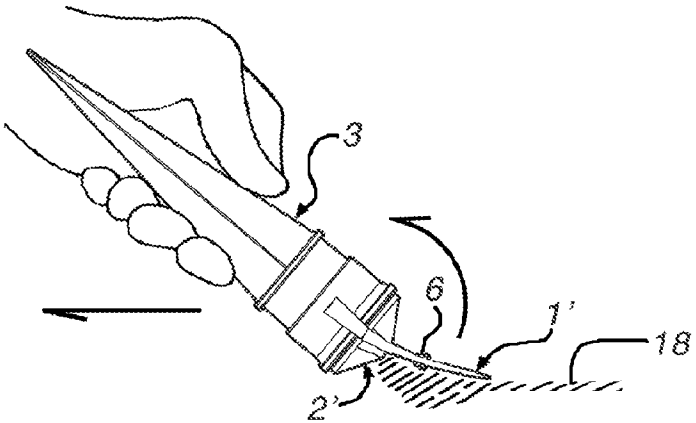

FIG. 34 illustrates the above alternate embodiment in side orthographic view, dispensing the repair compound 18.

Figure 35:
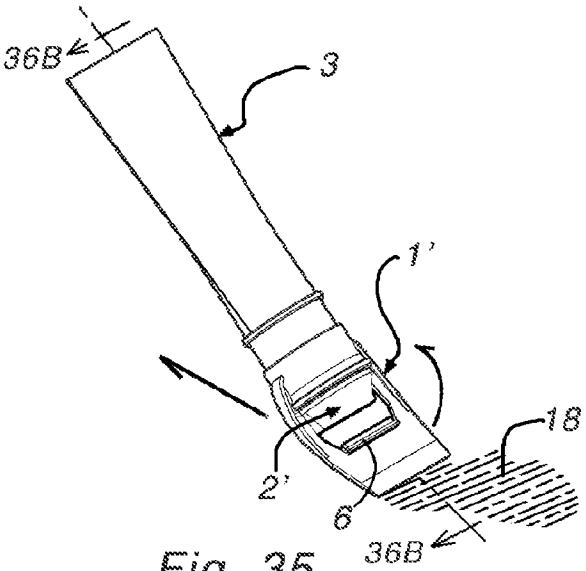

FIG. 35 illustrates the above alternate embodiment in perspective view, dispensing the repair compound 18.

Figure 36B:
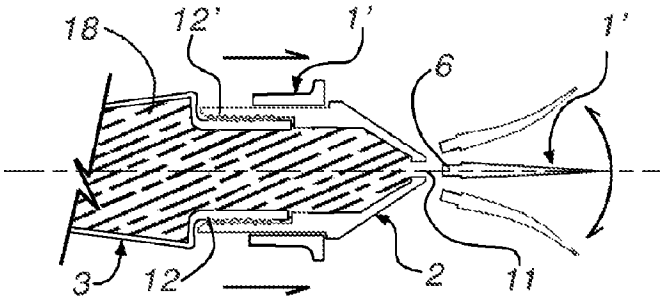
Figure 36A:
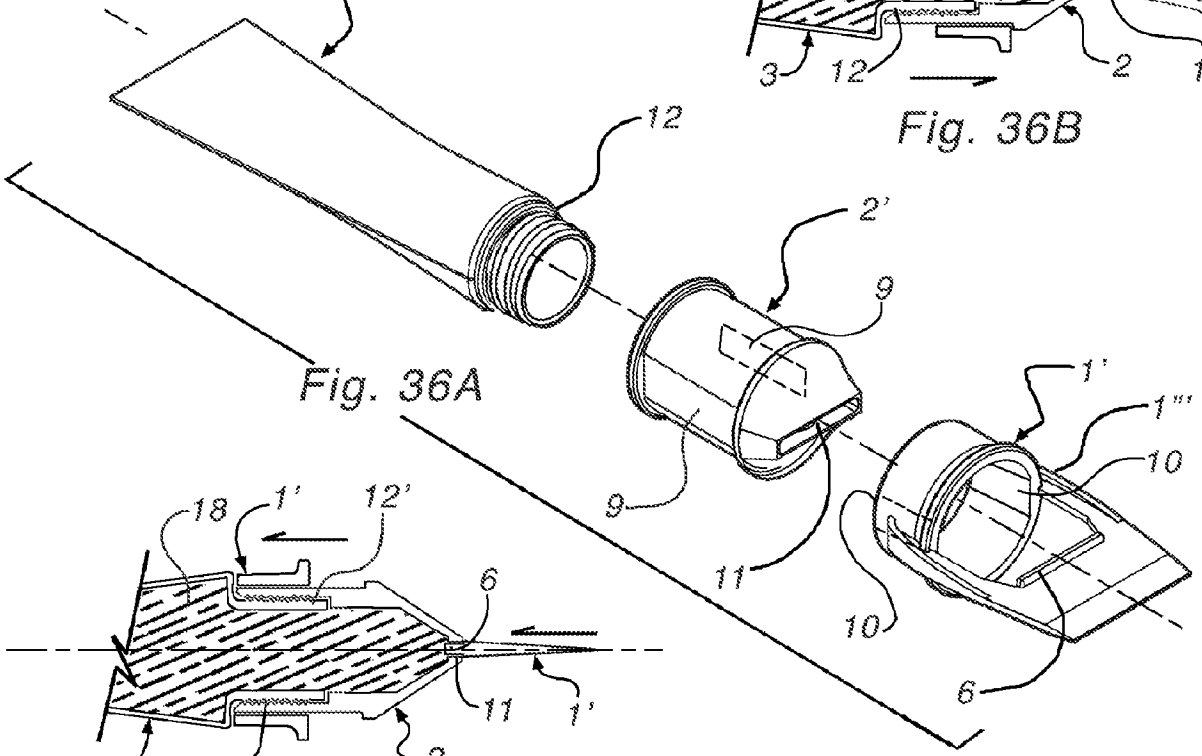

FIG. 36A illustrates the above alternate embodiment as seen in an exploded view.

FIG. 36B illustrates a section view of the preferred embodiment front half assembly showing the standing rib 6 disengaged from nozzle 2, along with the flexing direction and limits of smoothing blade 1 while in use.

Figure 36C:
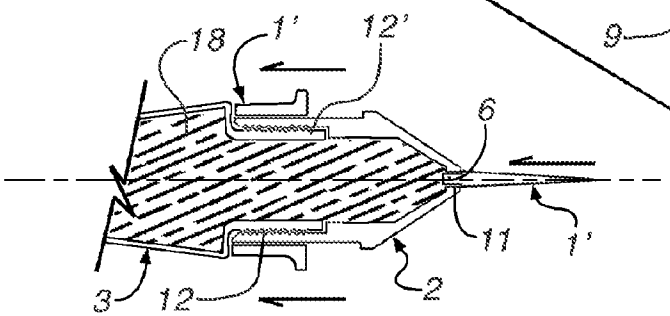

FIG. 36C illustrates a section view of the preferred embodiment front half assembly showing the standing rib 6 engaged into nozzle part 2.

DETAILED DESCRIPTION OF THE ILLUSTRATED EMBODIMENTS

It should be understood at the outset that although illustrative implementations of one or more embodiments are illustrated below, the disclosed components and subcomponents may be implemented using any number of techniques, whether currently known or in existence. The disclosure should in no way be limited to the illustrative implementations, drawings, and techniques illustrated below, but may be modified within the scope of the appended claims along with their full scope of equivalents.

As described in more detail below, the invention according to the first aspect of the disclosure includes compound dispensing devise that offers a simplified application of a repair compound or other viscous filler compound to a desired surface to be repaired. The inventions ease if use, accurate application of compound to the repair surface, and ease of cleanup, are all features that will appeal to the end user. These features are currently unavailable in a single product to today's consumer.

Figure 1:
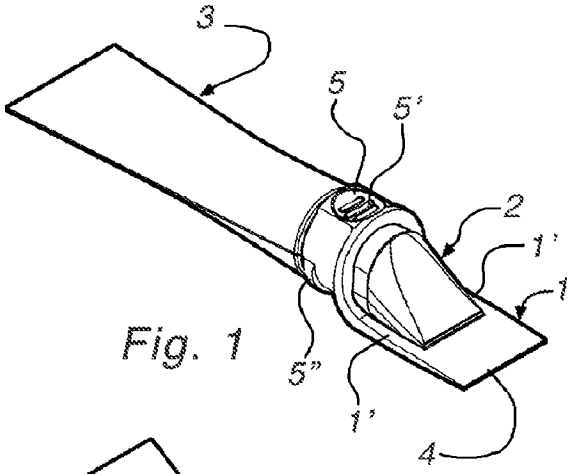
Figure 4:
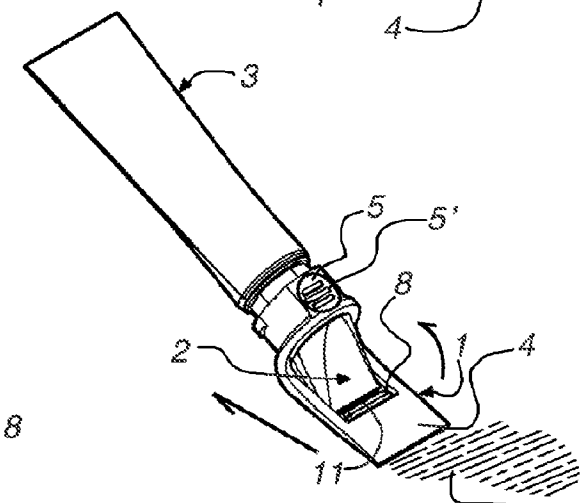
Figure 2:
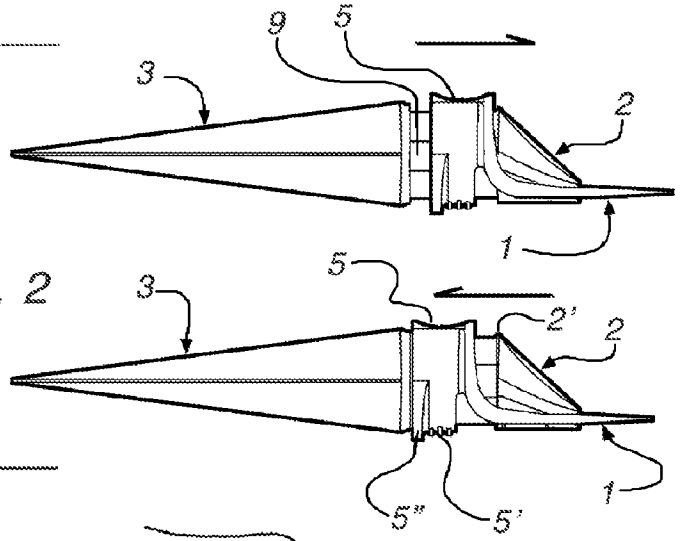
Figure 3:
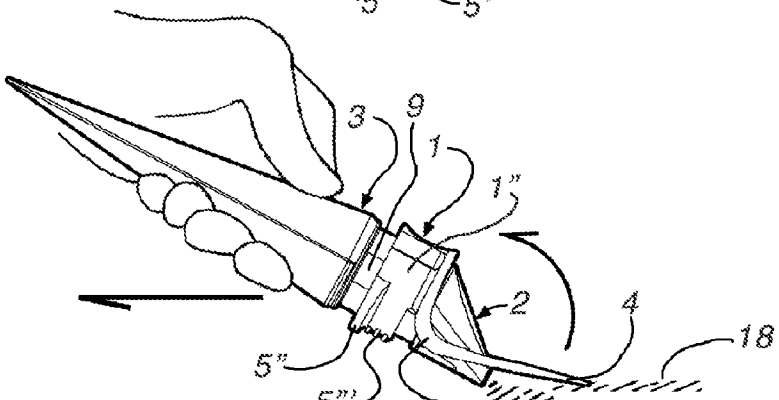
Figures 5A, 5B, 5C:
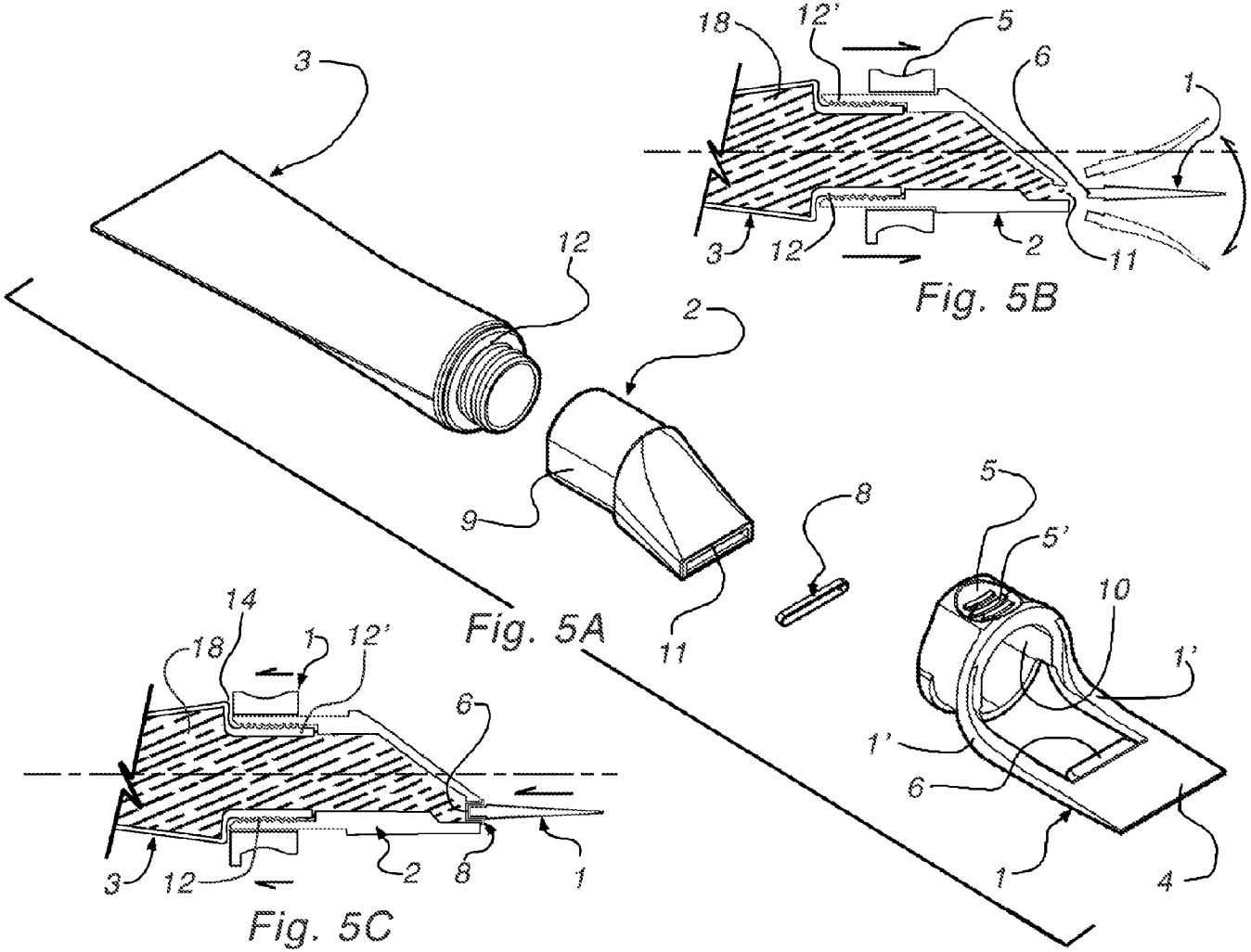
Figure 6:
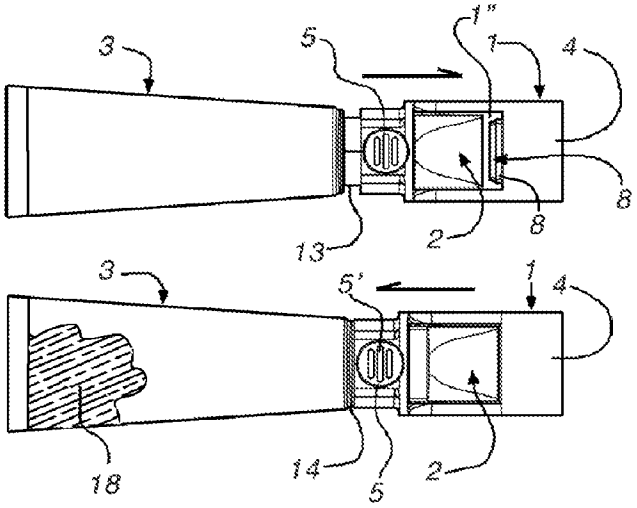
FIG. 6 and FIG. 7 illustrate the preferred embodiment in exemplary open and closed locations of smoothing blade 1 as seen in top and side orthographic views.

Referring to the drawings, a preferred embodiment of this invention is shown in FIG. 1 repair compound dispenser. The dispenser shown in FIG. 1 incorporates a container 3 which would be molded in a plastic so as to allow it to readily compress and which holds a predetermined amount of repair compound. This repair compound is commonly known as wallboard repair compound, joint compound, spackling paste, putty, wood filler, chalk, etc. Attached to the container 3 is a nozzle 2, that is a one-time factory force snap fit in place or screw mated to the container 3 achieving an airtight seal at their tangency. Before the container 3 and the nozzle 2 are mated in the factory, smoothing blade 1 is fitted onto nozzle 2 by sliding it's ring shaped front edge onto the back edge of nozzle 2 while pivoting the smoothing blade 1 at point 4 out of the way to allow for this mating. An alternate mating of smoothing blade 1 to nozzle 2 would be to press the back substantially ring shaped portion of the smoothing blade over the front of the nozzle, under force, with a one-time snap, fitting it over it's forward travel limit protrusion 2' that is molded into nozzle 2. Once mated, smoothing blade 1 slide articulates, moving forward and backward in a linear fashion, along profile 9 seen on in FIG. 3. The backward travel limit for smoothing blade 1 can be also molded into nozzle 2 as a raised rib protrusion on it's back edge or it can simply be the tangency of this part with the wider diameter seen in container 3 at area 14 as shown in FIG. 5C and FIG. 6. This sliding articulation of smoothing blade 1 allows for two key features of the invention, the first, functioning to open and close the dispensing nozzle 2 to allow for the administering of the repair compound and as seen in FIG. 2. During this dispensing the smoothing blade 1 is disengaged from the nozzle 2 at front orifice opening 11 as seen in FIG. 4. The second function, as seen in the open position views of smoothing blade 2 in FIG. 3 and FIG. 4, allows the twin rails 1', to flex under the required, user applied, downward pressure needed to be exerted on smoothing blade 1 at it's front 4 location while smoothing the extruded repair compound 18 to the desired repair surface. This downward pressure and flexing of the smoothing blade 1 at twin rails 1', allows closure plug 6 to pivot up and out of the way of the repair compound 18 extrusion delivery as seen in FIG. 3. Smoothing blade 1 is to be molded out of a thermoplastic material such as polypropylene or similar material to allows for the flexing and resiliency needed in this part. Smoothing blade 1 has a ring shaped back half which snaps to nozzle 2 and this ring shaped back half, also has a recess thumb grip and raised texture as shown in details 5, 5', 5" and 5'" of FIG. 3 and FIG. 4. These grips and texture allow a user to single handedly have control over the sliding of smoothing blade 1, easily motioning it closed for an air-tight seal when closure plug 6 intersects with nozzle 2 at tangency 11, and to allow for the open dispensing position seen in FIG. 3 and FIG. 4. Smoothing blade 1 has a standing rib 5" and grip details 5'" located and projecting substantially from it's underside, which aid the users index finger to grip and pull the smoothing blade 1 to a closed position in combination with the same pulling action the users thumb exerts on thumb grip 5, both allowing for the ease of closure for this part.

FIG. 5A shows an exploded view of the subassembly parts that make up the preferred embodiment of the invention. A pliable rubber or vinyl like gasket 8 can be considered as an optional part which would locate to smoothing blade 1 fitting onto as a ring under stretched tension, or snapping onto, and fully covering closure plug 6. Gasket 8 will be fixed to closure plug 8 with the addition of glue or other means if needed, to ensure that the action of sliding open the smoothing blade assembly will not cause the this gasket 8 part to dislodge from closure plug 6. An optimal method for fixing this gasket 8 to closure plug 6 would be to in-mold it to smoothing blade 1 at closure plug 6, in a 2 stage injection molding process with this assembly being derived from the same injection mold. This optional gasket 8 ensures that when mating closure plug 6 into opening 11 of nozzle 2, an air-tight seal is achieved so the contained repair compound 18 will remain pliable when the invention is stored for non-use.

FIG. 5B illustrates a partial section view of the preferred embodiment's front half assembly showing the closure plug 6 disengaged from nozzle 2, along with showing the lateral flexing limits of smoothing blade 1 while in use. Closure plug 6 has a perimeter form that matches that of through hole dispensing orifice 11. The smoothing blade 1 is shown slid open to allow nozzle orifice 11 to be free to dispense repair compound 18.

FIG. 5C illustrates a partial section view of the preferred embodiment's front half assembly showing the closure plug 6 engaged into nozzle part 2 at orifice 11, along with the addition of the pliable gasket 8 which aids in achieving an air-tight closure at this juncture.

Figure 7:
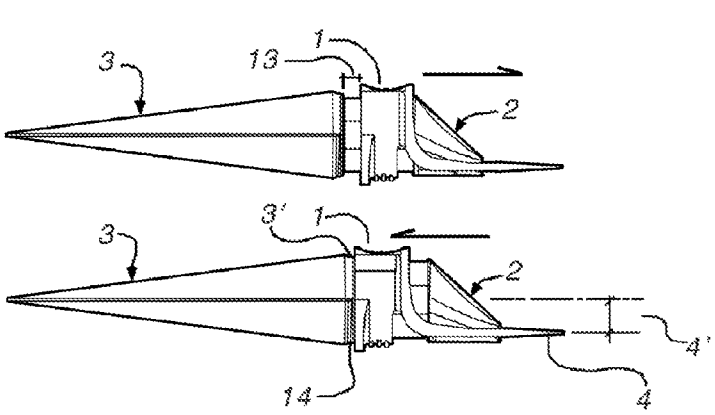

FIG. 6 and FIG. 7 show the fully open and fully closed locations of smoothing blade 1 as seen in top and side orthographic views. Closure plug 6 and gasket 8 are seen in the top view of FIG. 6 and through hole area 1" is presented when smoothing blade 1 is motioned to it's forward most, dispensing position. When in the closed position, tangency 14 is the rear extent limit of the travel for smoothing blade 1, where it meets the container 3 at edge 3' and as seen in the lower drawing of FIG. 7. This position seals the container 3 and it's compound 18 for storage, keeping it fresh and pliable for future use. Smoothing blade 1 extends vertically lower then the assembly's center line as seen in FIG. 7, detail 4', and matches with the same vertical centerline offset as seen on the nozzle 2 dispensing end. This allows for the repair compound 18 to be dispensed more accurately, coming in direct contact with the wall or surface that requires repair right from the exit point of nozzle 2 at orifice opening 11, requiring no more offset of the invention to the repair surface than that which is ergonomically required when gripping the invention. The viscosity of the repair compound 18 helps determine it's ability to have tensile adhesion with the repair surface. A desirable adhesion is for the initial extruded repair compound 18 to readily adhere to the repair surface in a duration long enough for the smoothing blade 1 to affect it.

Figure 8:
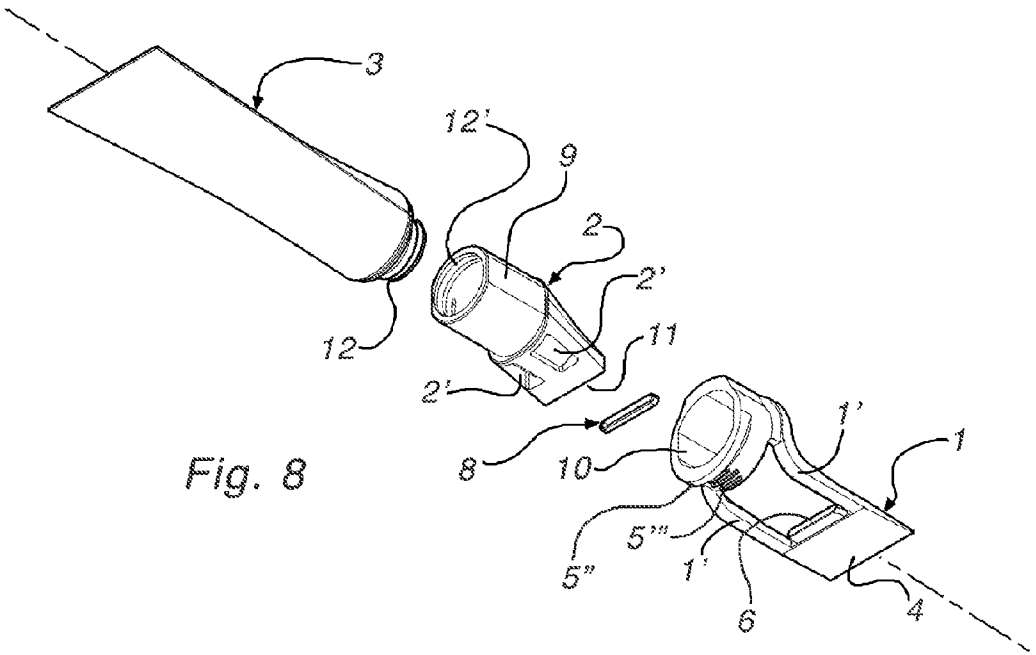
FIG. 8 and FIG. 9 illustrate the preferred embodiment in exploded views showing the subassembly parts as seen in an underside perspective view and a side view.

FIG. 8 shows an underside exploded view of the subassembly parts for the invention. Depicted in this drawing on the smoothing blade 1 are, a closure plug 6, along with grip details 5", and 5'". This view also shows the nozzle 2 and twin mirror image recesses in this part 2', which function to relieve the injection molded plastic thickness, allowing the part to be more readily moldable, while at the same time ensuring an efficient interior channel chase required for the smooth deliver of the compound 18. A gasket 8, which is molded to, glued to, or fixed with tension to closure plug 6 is also shown. Container 3 is shown having a threaded finish 12 that screw connects to nozzle 2 at the interior threads 12'.

Figure 9:
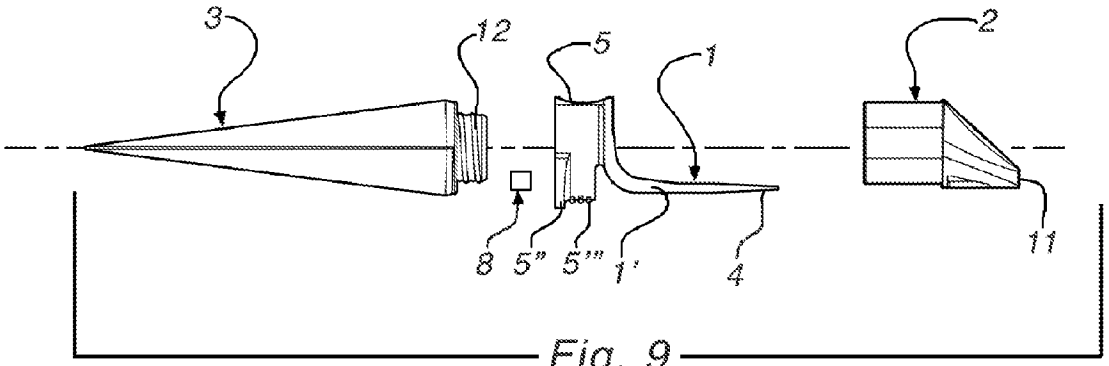

FIG. 9 shows a side orthographic exploded drawing of the invention's subassemblies in an optimal orientation used by the factory to assemble the invention. Grip details 5, 5", and 5'" on the smoothing blade 1 are shown along with optional gasket 8.

Figure 10:
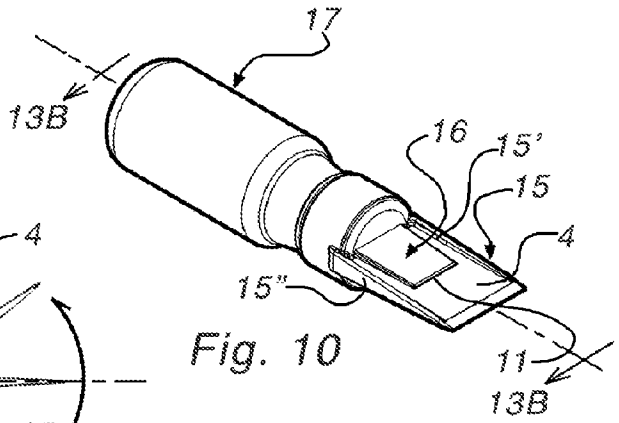
FIG. 10 illustrates an alternate embodiment for the container 1 as seen in bottle 17 instead of a tube as depicted in above figures.

FIG. 10 illustrates an alternate embodiment for the repair compound 18 containment vessel, shown here as a bottle container 17, which would be molded in a plastic such as polyethylene to allow it to readily compress at it's mid-section, and as with the previous depictions, it would contain a repair compound 18. The repair compound 18 is to be dispensed out of nozzle 16 at opening 11 when the container 17 is squeezed.

Figure 11:
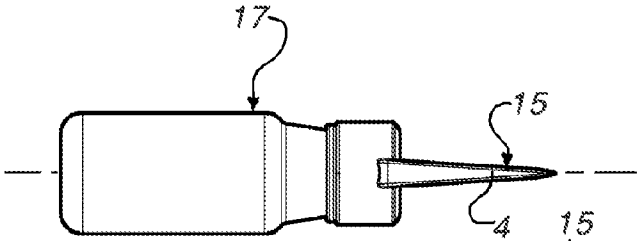
FIG. 11 illustrates the above alternate embodiment as seen in a side view, and showing container 17 and smoothing blade 15.

FIG. 11 illustrates the above alternate embodiment as seen in a side view, and showing container 17 and smoothing blade 15. In this embodiment, the smoothing blade 15 functions in a non-linear articulating location, snapped or screw located to the top of container 17 at the open end finish screw threads as seen in FIG. 14. Smoothing blade 15 of this embodiment will have the same lateral flexing motion as seen in the previous embodiments.

Figure 12:
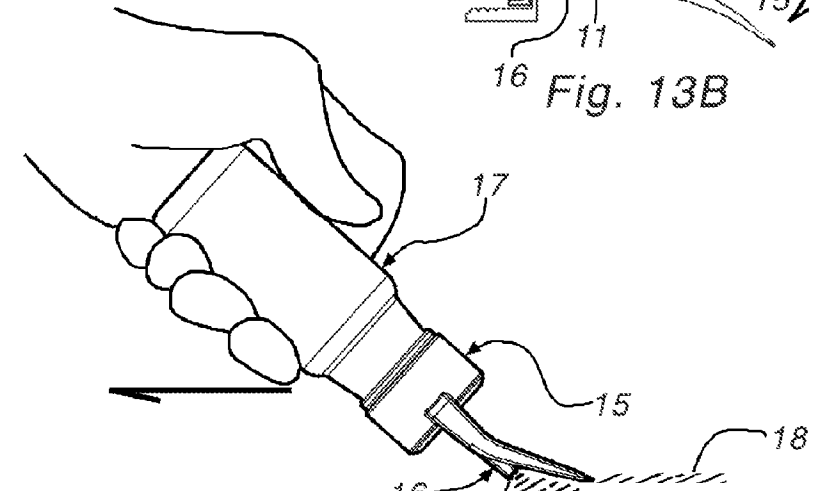
FIG. 12 illustrates a partial front assembly alternate embodiment in side orthographic view, dispensing the repair compound 18.

FIG. 12 illustrates the above alternate embodiment in side orthographic view, dispensing the repair compound 18. Nozzle part 16 is shown dispensing compound 18 while container 17 is squeezed and smoothing blade 15 end portion 4 is deflected away from it's closure tangency with orifice 11 of nozzle 16. Dispensing orifice 11 is depicted in contact to the surface to be repaired through the deflection of smoothing blade 15 at rails 15' and 15" and as seen in FIG. 13A.

FIG. 13A illustrates the above alternate embodiment dispensing the repair compound 18 and as seen a perspective view showing knife 15 tangency 15' pivoted away from the closed air-tight horizontal mating position depicted in FIG. 10 where the orifice 11 is sealed.

FIG. 13B shows a sectional view of smoothing blade 15 and nozzle 16 with smoothing blade 15 shown in closed and flexing locations necessary for the dispensing of the repair compound and for applying this compound in a manner that will allow it to be smoothed out onto the repair surface once swept over by the smoothing blade 15 at blade area 4. Smoothing blade 15 has screw threads as shown in detail 12. These screw threads can be considered to be alternate methods of securing smoothing tool 15 to container 17, such as a bayonet mount interlock, one-time snap fit, etc. Smoothing blade 15 is shown flexed to it's upper and lower limits which are necessary for the release of closure plug 6 from orifice 11. Closure plug 6 would have the option for an integrally fit or molded rubber or vinyl-like compression gasket at its end, which allows for a compression air-tight seal to nozzle 2' at dispensing area 11.

FIG. 13C shows a partial sectional view of the front assembly where the smoothing blade 1' has an articulating closure plug 6' which would form an air-tight seal to the orifice 11. This air-tight seal would present itself when smoothing blade 1' end is kept in it's horizontal closed position. In this position, the closure plug 6' will snap and moderately intersect to orifice 11, holding in place and covering the orifice opening 11 on nozzle 16. Closure plug 6 could also be considered to be spring loaded so that it has a limited linear articulation, forward and back to allow a snap compression fit to at this closure juncture and a more positive compression seal to the orifice 11 at the position when the smoothing blade is at a horizontal closed position.

FIG. 13C illustrates a partial assembly embodiment as seen in a sectional view, showing the smoothing blade 15 and it's range and direction of travel with an optional articulating tension seal 6' shown inserted and slidably trapped to smoothing blade 15. An optional gasket 16' which is disk shaped with a central through hole, is also shown which functions to supply an air-tight seal between the container 17 an the nozzle 16.

FIG. 13D illustrates a partial exploded view embodiment of the smoothing blade 15 with the optional articulating compression seal 6', which in certain embodiments may have twin pivot ends 6" and 6'" and their respective locator receptor grooves or holes 4' and 4" to be located on the inside rail surface of smoothing blade 15. In all embodiments compression seal 6' would rotate about its end pivot points 6" and 6'". The compression seal 6' may also function with the addition of a spring or integrally molded spring which would allow this compression seal 6' to move slightly along the Axis of the receptors grooves 4' and 4" when the nozzle end 16 interfaces with it, and these springs will allow for a constant pressure of compression seal 6 against the nozzle at orifice 16'.

FIG. 13E illustrates the nozzle 16 as seen in perspective view, showing the end orifice termination point 16' as being contoured to readily accept the articulated tension seal 6' through having a substantially concave axial perimeter.

FIG. 14 illustrates the above alternate embodiment as seen in an exploded view, and showing container 17, it's threaded finish 12, nozzle 16 with it's dispensing opening 11, and smoothing blade 15 with it's through hole slot 19 which allows nozzle 16 front extension to pierce through and locate to closure plug 6. Nozzle end 16 at orifice 11 will snap-fit and friction seat to closure plug 6 for an air-tight seal when smoothing blade 15 front portion 4 is flex to be centered over orifice 11. The employment of a rubber or vinyl like gasket or in-mold seal can be optionally considered at this juncture and is seen in this drawing as gasket 8.

FIG. 15 illustrates the above alternate embodiment as seen in a vertical standing perspective view, and showing container 17, nozzle 16, and smoothing blade 15.

FIG. 16 illustrates an alternate embodiment in which the repair compound's container is a substantially bellows shaped container 21 which would contain and dispense a repair compound 18. When squeezed, the bellows container will readily compress in the directions that a users hand would apply a pinching compression pressure. Smoothing blade 20 flexes along twin rails 20' and 20", allowing for opening the air-tight closure with container 21, and allowing for the dispensing of the repair compound 18 out of orifice 11. Smoothing blade 20 would have a hoop 20'" integrally molded to it which allows it to locate to bellows container 21 with a one-time snap to be done at the factory. The bellows accordion squeezing action required to dispense the repair compound 18 would deflect and flex above and below this rigid hoop 20'".

FIG. 17 illustrates the bellows container 21 and knife 20 as seen in top and side orthographic views.

FIG. 18 illustrates the above embodiment of the invention as seen in a side orthographic view while dispensing repair compound 18. Bellows container 21 has a integrally molded nozzle end 21'" and a nozzle termination point as seen in orifice 11 which directs and extrudes the compound 18 onto the repair surface.

FIG. 19 illustrates a perspective view of the invention while dispensing repair compound 18. Smoothing blade 20 is shown flexed along rails 20' and 20" to allow for the disengagement of bellows nozzle 21' at orifice 11. Smoothing blade 20 is flexed while under downward pressure from the user and is in contact with the repair surface. This allows for bellows container forward nozzle 21' to be open and unobstructed for extruding the repair compound 18 and also allows smoothing blade 20 at it's front portion 4 to affect the repair compound 18.

FIG. 20 illustrates an exploded view for the above embodiment and details Container 21, it's integral nozzle 21', smoothing blade 20, and the containment hoop 20'". The potential exists to allow for logo printing or in-mold engraving in the bellows container 21 on face 22. A recessed channel is found at the mid section of bellows container 21, which will match to and allow the hoop 20'" section of smoothing blade 20 to locate to for a one-time force fit at the factory.

FIG. 21 illustrates an alternate embodiment for the invention in which knife 15 shares the same centerline as the container 3 as seen in the side view of FIG. 22. The smoothing blade 15 flexes along twin rails 15' and 15", pivoting up or down and away from its fixed horizontal mode as seen in this view. Nozzle 16 is trapped in place in a fixed non-rotating position while sandwiched between smoothing blade 15 and container 3. Smoothing blade 15 will screw or one-time factory snap together to container 3 under force. A facet or standing rib or other means which is customary to those skilled in the trade will allow nozzle 16 to stay in it's lateral orientation and not rotate from it's aligned position with the raised closure surface 15".

FIG. 22 illustrates the above alternate embodiment as seen in a side view, and showing container 3, nozzle 16 and smoothing blade 15.

FIG. 23 illustrates the above alternate embodiment as seen in side orthographic view, dispensing the repair compound 18. Nozzle 16 is shown dispensing repair compound 18 while container 3 is squeezed and while smoothing blade 15 is deflected away from it's closure air-tight closure alignment with raised closure surface 15'". The orifice opening 11 is shown in a preferred dispensing orientation with contact or in close contact to the surface to be repaired.

FIG. 24 shows an in-use perspective view of the invention, dispensing the repair compound 18, showing smoothing blade 15 and raised closure surface 15'" pivoted away from the closed air-tight horizontal mating position as seen in FIG. 21.

FIG. 25A illustrates the above embodiment as seen in an exploded view, and showing container 3, screw threads 12 on container 3, screw threads 9 on smoothing blade 15, raised closure surface 15'", nozzle 16 with it's repair compound dispensing opening 11 in their preferred orientation for factory assembly.

FIG. 25B illustrates the above embodiment as seen in a sectional view, and showing container 3, repair compound 18, nozzle 16, and the smoothing blade 15 shown in its upper and lower desired range of motion when in use which also shows orifice 11 open to dispense the repair compound 18.

FIG. 25C illustrates the above embodiment as seen in a sectional view, and showing container 3, repair compound 18, nozzle 16, and the smoothing blade 15 shown in it's closed air-tight position and sealing off the orifice 11 at raised closure surface 15'''.

FIG. 26 illustrates an alternate embodiment for the invention in which smoothing blade 23 motions forward to open the container and motions backward to close and air-tight seal the container. This smoothing blade 23 intersects inside the nozzle 24 and has a limit to it's linear movement as seen in FIG. 27 at detail 23'''. FIG. 26 shows smoothing blade 23 in it's forward most position pulled away from tangency surface 24'. Nozzle 24 contains a through hole orifice 24" on it's underside and seen in FIG. 30, to allow for the dispensing of the repair compound 18. Nozzle 24 is trapped to container 3 in a fixed non-rotating position and screwed or assembled as a one-time factory force snap-fit with part 3 in which an airtight seal is achieved. A facet or standing rib allows dispensing nozzle 24 to stay in it's non-rotating lateral orientation as shown, or any other means ascertainable by one skilled in the art and could be made without departing from the spirit and scope disclosed herein. Dispensing nozzle 24 would be assembled to container 3 by utilizing a factory one-time press-fit, screws threads, or a bayonet type of connection with the end mated position of these parts allowing for them to be in a consistent lateral alignment required to match to the shape of container 3 and/or exterior graphic labels. Smoothing blade 23 has a through hole void 23''' which aids in viewing the repair compound 18 being dispensed and for allowing twin rails 23' and 23" to flex for accurate variable pressure of smoothing blade 23 end to repair surface. Smoothing blade 23 inserts into nozzle 24 at through hole orifice 11 to form an air-tight closure. The employment of a gasket or an in-mold gasket in a rubber or soft vinyl-like material at the perimeter of this opening will further enhance the keep an air-tight seal.

FIG. 27 shows the above alternate embodiment as seen in a side view showing smoothing blade 23 in the extended dispensing mode and in the closed mode. The upper image of FIG. 27 shows the horizontal offset of smoothing blade 23 from nozzle 24 at area 23'''. The middle image of FIG. 27 shows the vertical offset of smoothing blade 23 from the center line of container 3 at area 4'. This vertical offset aids in the delivery of the repair compound in an accurate manner and allows for it to be extruded from the 24" orifice directly to the repair surface. This is especially important when applying the repair compound 18 to a vertical surface where the compound 18 needs to stick to the repair surface before the smoothing blade comes in contact with it.

FIG. 28 illustrates the above alternate embodiment in side orthographic view, dispensing the repair compound 18. Nozzle part 24 is shown dispensing repair compound 18 while container 3 is squeezed and smoothing blade 23 is extended outward and away from it's closure air-tight closure sealing tangency. This closed air-tight tangency is seen in the meeting of sloped surfaces 23'''' and 24' shown in the lower image of FIG. 27.

FIG. 29 illustrates the above alternate embodiment dispensing the repair compound 18 as seen a perspective view, showing knife 23 pulled forward and away from the closed air-tight horizontal mating position with the forward end 4 of smoothing blade 23 flexed while applying compound to the repaired surface.

FIG. 30 illustrates the above embodiment as seen in a partial exploded view showing knife 23 disengaged from the nozzle 24, with knife 23 having a channel 23'''' that directs the repair compound towards the orifice opening 24" seen in nozzle 24. A through hole window 23''' is also shown which aids in allowing the user to accurately see the surface to be repaired and aim the extruding repair compound 18 towards this area.

FIG. 31 shows an exploded perspective view showing knife 23 disengaged from the nozzle 24 and showing the exit orifice through hole 24" in nozzle 24. Container 3 is also shown along with the screw threads 12 molded into it's end finish which will mate to receptor screw threads 12', on the inside of nozzle 24 as seen in FIG. 30.

FIG. 32 illustrates an alternate embodiment for the invention which comprises a container 3, containing a dispensable repair compound 18 to be dispensed when the container 3 is squeezed. Smoothing blade 1' flexes along twin rails 1" and 1''', pivoting up or down and away from its fixed horizontal closure mode seen in this view.

FIG. 33 illustrates a side view and top orthographic view showing container 3, nozzle 2', and smoothing blade 1' with the main difference to the embodiment depicted in FIG. 1-9, being that the nozzle 2' and smoothing blade 1' share the same centerline as that of the container 3.

FIG. 34 illustrates the above alternate embodiment in side orthographic view, dispensing the repair compound 18. Nozzle 2' is shown dispensing compound 18 while container 3 is squeezed and smoothing blade 1' end is deflected away from it's closure tangency with nozzle 2' at blade closure surface 6.

FIG. 35 illustrates the above alternate embodiment dispensing the repair compound 18 and as seen a perspective view showing knife 1' closure surface 6 pivoted away from the closed air-tight horizontal mating position 1'''' as seen in FIG. 32.

FIG. 36A illustrates the above alternate embodiment as seen in an exploded view. Smoothing blade 1', nozzle 2', and container 3 make up this subassembly. Screw threads 12 are shown on the end finish of container 3, the nozzle dispensing opening 11, along with twin planar facet 9 on nozzle 2'. Nozzle 2 twin facet 9 repeats itself on the opposite side this part and matches to the inner twin Facet 10 as seen on smoothing blade 1'. These facets keep nozzle 9 from rotating laterally and ensure that the orifice 11 will match to the closure surface 6. Smoothing blade 1' has a closure surface 6 which would have the option for an integrally fit or molded rubber or vinyl-like compression gasket at its end, which allows for an airtight seal to nozzle 2' at dispensing area 11 when smoothing blade 1' end is kept in it's horizontal closed position. In this position, the closure surface 6 will snap and hold in place over the orifice opening 11 on nozzle 2'. Closure surface 6 could also be considered to be spring loaded so that it articulates forward and back to allow a snap compression fit to at this closure juncture and at the position when the smoothing blade is at a horizontal closed position.

FIG. 36B illustrates a partial section view of the above embodiment showing the closure plug 6 disengaged from nozzle 2 at opening 11, along with the flexing direction and limits of smoothing blade 1' while in use.

FIG. 36C illustrates a partial section view of the preferred embodiment showing the closure plug 6 engaged into nozzle part 2 at orifice 11, in the inventions sealed for storage mode, achieving an air-tight closure for the contained repair compound 18.

While several aspects of the disclosure have been provided above, it should be noted that the disclosed exemplars, assemblies, and subassemblies may be embodied in many other specific forms without departing from the spirit or scope of the present disclosure. The present disclosure is considered as illustrative and not restrictive, and various elements or components from one or more of the above described aspects of the disclosure may be combined or integrated together or certain features may be omitted. Similarly, any of the various elements or components described in conjunction with one of the above aspects of the disclosure may be combined with or may replace corresponding elements or components of any of the other aspects of the disclosure. Other examples of changes, substitutions, and alterations are ascertainable by one skilled in the art and could be made without departing from the spirit and scope disclosed herein.

Having thus described the invention, what is claimed is:

1. A repair-compound dispenser, comprised of a container that is at least partially compressible and is constructed for dispensing a repair compound contained therein from an opening thereof when the container is compressed; and a delivery device that enables a user to single-handedly dispense repair compound received from said container and also to smooth the dispensed repair compound deposited upon a receiving surface; said delivery device comprising:

(A) a dispensing nozzle part that is constructed to communicate with said opening of said container and that has a passageway for the passage of repair compound received from said container, at said opening thereof, from a rearward inlet end of said passageway to a forwardly spaced outlet orifice thereof;

(B) a smoothing blade part operatively associated with said nozzle part and having a blade portion that extends forwardly beyond said outlet orifice of said nozzle part passageway and that terminates in a generally rectilinear leading edge, said blade portion being constructed for forcing a repair compound into subsurface recesses and defects of a receiving surface on which the repair compound is deposited, and for smoothing the surface of the deposit; and (C) a closure element on said blade part that is constructed to close said forwardly spaced outlet orifice of said nozzle part passageway, said blade part being movable between a closing position, in which said closure element effectively closes said outlet orifice of said nozzle part, and at least one opening position in which said closure element is displaced from said outlet orifice to permit repair compound to pass therethrough, at least one of said nozzle part and said blade part having means for attachment to said container.

2. The dispenser of claim 1 wherein said container is in the form of a resilient tube or bottle, or is of substantially bellows-like form.

3. The dispenser of claim 1 wherein said nozzle part is integrally formed with said container, and wherein said means for attachment is on said blade part.

4. The dispenser of claim 1 wherein said nozzle part and said blade part comprise an assembly that is disengageable from said container and is attached thereto by said means for attachment, said nozzle part being constructed for engagement with said container at said opening thereof and for so communicating with said opening.

5. A hand-held delivery device that enables a user to single-handedly dispense a repair compound received from an attached container that is at least partially compressible and is constructed for dispensing a repair compound contained therein through an opening thereof when compressed, and also enables a user to smooth a repair compound dispensed from said delivery device and deposited upon a receiving surface, said delivery device comprising:

(A) a dispensing nozzle part that is constructed for engagement with a container and that has a passageway for the passage of a repair compound received through a rearward inlet end of said passageway to a forwardly spaced outlet orifice thereof;

(B) a smoothing blade part operatively associated with said nozzle part and having a blade portion that extends forwardly beyond said outlet orifice of said nozzle part passageway and that terminates in a generally rectilinear leading edge, said blade portion being constructed for forcing a repair compound into subsurface recesses and defects of a receiving surface on which the repair compound is deposited, and for smoothing the surface of the deposit; and (C) a closure element on said blade part that is constructed to close said forwardly spaced outlet orifice of said nozzle part passageway, said blade part being movable between a closing position, in which said closure element effectively closes said outlet orifice of said nozzle part, and at least one opening position in which said closure element is displaced from said outlet orifice to permit repair compound to pass therethrough, at least one of said dispensing nozzle part and said smoothing blade part having means thereon for attachment of said delivery device to such a container with said passageway of said nozzle part positioned to receive repair compound from an opening of the container.

6. The dispenser of claim 5 wherein said blade part is slidably mounted on said nozzle part for linear movement between said closing position and said at least one opening position of said blade part.

7. The dispenser of claim 6 wherein said nozzle part comprises a tubular portion located rearwardly of said outlet orifice and having a longitudinal axis, and wherein said blade part comprises a coaxial collar portion at least partially encircling said tubular portion of said nozzle part.

8. The dispenser of claim 7 wherein at least the exterior of said tubular portion of said nozzle part is substantially cylindrical, and wherein said collar portion is ring shaped, said delivery device being constructed to prevent relative rotation of said blade part on said nozzle part about said longitudinal axis of said tubular portion.

9. The dispenser of claim 7 wherein said collar portion has at least one structural feature for enhancing manual engagement thereof to thereby facilitate one-handed movement of said blade part between said closing position and said at least one opening position.

10. The dispenser of claim 5 wherein said blade part comprises a forwardmost, generally planar plate portion on which said rectilinear leading edge is provided, and a pair of laterally spaced rails connecting said plate portion to said collar portion and defining an open area therebetween, said outlet orifice of said passageway of said nozzle part being aligned with said open area of said blade part in said opening position thereof so as to permit passage of repair compound through said open area for deposit upon such a receiving surface.

11. The dispenser of claim 10 wherein said rails are constructed to permit resilient deflection of said plate portion of said blade part in opposite, transverse directions, generally normal to a plane thereof, in reaction to force applied thereto.

12. The dispenser of claim 11 wherein, in an unflexed position, said plate of said plate portion of said blade part is offset substantially from said longitudinal axis of said tubular portion of said nozzle part.

13. The dispenser of claim 5 wherein a bearing surface of said closure element on said blade part bears upon structure defining said outlet orifice of said nozzle part passageway to effect sealing of said outlet orifice in said closing position of said blade part.

14. The dispenser of claim 13 wherein said bearing surface of said closure element is substantially flat.

15. The dispenser of claim 14 wherein said nozzle part defines a channel extending inwardly from a forward end thereof and having a bottom wall in which said outlet orifice is formed, and wherein said blade part includes a rearward end portion that is slideably received in said channel of said nozzle part for movement between said closing position and said opening positions, said rearward end portion of said blade part overlying said outlet orifice, to block the flow of repair compound therethrough, in said closing position.

16. The dispenser of claim 13 wherein said closure element is of plug-like form and resides within said outlet orifice of said passageway in said closing position.

17. The dispenser of claim 13 wherein a gasket element is associated with one of said structure defining said outlet orifice of said nozzle part passageway and said closure element of said blade part, said gasket element lying in direct surface contact with the other of said structure defining said orifice and said closure element to promote air-tight sealing of said outlet orifice in said closing position.

18. The dispenser of claim 5 wherein said passage of said nozzle part includes a portion, proximate said outlet orifice thereof, that tapers in the direction of said orifice.

* * * * *